US012180813B2

(12) United States Patent
Mahadevan et al.

(10) Patent No.: US 12,180,813 B2
(45) Date of Patent: Dec. 31, 2024

(54) METHODS AND SYSTEMS TO MANAGE IMPURE CO2 INJECTION

(71) Applicant: Air Products and Chemicals, Inc., Allentown, PA (US)

(72) Inventors: Jagannathan Mahadevan, Sugarland, TX (US); Vipul S. Parekh, Allentown, PA (US); Micah S. Kiffer, Kutztown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 18/211,327

(22) Filed: Jun. 19, 2023

(65) Prior Publication Data

US 2023/0407734 A1 Dec. 21, 2023

Related U.S. Application Data

(60) Provisional application No. 63/353,039, filed on Jun. 17, 2022.

(51) Int. Cl.
*E21B 43/16* (2006.01)
*E21B 47/06* (2012.01)

(52) U.S. Cl.
CPC ..... *E21B 43/164* (2013.01); *E21B 47/06* (2013.01)

(58) Field of Classification Search
None
See application file for complete search history.

(56) References Cited

U.S. PATENT DOCUMENTS

2007/0295512 A1 12/2007 Jurczyk et al.
2010/0287123 A1* 11/2010 Verma ..... F17D 3/01 705/500
2012/0003043 A1 1/2012 Cawley et al.
(Continued)

FOREIGN PATENT DOCUMENTS

CN 110552671 A1 12/2019
WO 2010103275 A1 9/2010

OTHER PUBLICATIONS

Luna-Ortiz; "Impact of Hydrogen as Impurity in the Physical and Transport Properties of CO2 Streams in CCS/CCUS Transport Systems: a Technical Discussion"; 15th International Conference on Greenhouse Gas Control Technologies, GHGT-15; Mar. 2021; p. 1-17. (Year: 2021).*

*Primary Examiner* — Andrew Sue-Ako
(74) *Attorney, Agent, or Firm* — Jason M. Ploeger

(57) ABSTRACT

A method comprising reducing the pressure of a carbon dioxide injection stream with a first pressure reducer having a depth and producing a reduced pressure carbon dioxide stream; reducing the pressure of the reduced pressure carbon dioxide stream with a second pressure reducer positioned at a lower depth than the first pressure reducer to produce a further reduced pressure carbon dioxide stream; and injecting the further reduced pressure carbon dioxide stream into a reservoir having a depth; wherein the pressure of the carbon dioxide stream at the depth of the first pressure reducer is greater than a bubble point pressure of the carbon dioxide injection stream at the depth of the first pressure reducer; wherein the pressure of the further reduced pressure carbon dioxide stream at the depth of the reservoir is less than a minimum fracture pressure of the reservoir at the depth of the reservoir.

15 Claims, 4 Drawing Sheets

(56) References Cited

U.S. PATENT DOCUMENTS

| | | | |
|---|---|---|---|
| 2013/0075514 | A1 | 3/2013 | Fiorucci |
| 2013/0170910 | A1 | 7/2013 | Hoier et al. |
| 2013/0223935 | A1 | 8/2013 | Hoier et al. |

* cited by examiner

METHODS AND SYSTEMS TO MANAGE IMPURE CO2 INJECTION

CROSS-REFERENCE TO RELATED APPLICATIONS

This application claims priority to U.S. Provisional Patent Application No. 63/353,039, filed on Jun. 17, 2022.

BACKGROUND

Existing industrial processes such as power generation will need to capture carbon dioxide (CO2) to mitigate the effects of climate change. Captured CO2 streams typically require removal of water and light components such as nitrogen before utilization or sequestration, however some components such as hydrogen cannot be easily removed. Hydrogen may exacerbate phase separation, which in turn may form a hydrogen-rich gas phase that can embrittle metals in the pipeline or well. Other impurities may exacerbate the formation of a gas phase.

It is desirable to keep the CO2 stream in a single phase at the injection site to ensure smooth flow into the injection well, prevent hydrogen embrittlement, and prevent acid formation. Single-phase flow may be ensured by keeping the pressure above the bubble point pressure, defined as the pressure at which the first bubble of vapor is formed in the liquid phase at a given temperature. For deeper formations, high enough injection pressures are required so that the CO2 is kept in a single phase. However, shallower reservoirs require lower injection pressures and risk phase separation as a result. An additional constraint is applied by the reservoir itself, which has a minimum fracture pressure, above which the rock formation may be damaged to the point that CO2 can escape the reservoir.

SUMMARY

Methods and systems for injection of a CO2 stream into a subsurface formation are disclosed herein. The CO2 stream may pass through a first pressure reducer such as a control valve at the surface which may impart a first pressure drop to the CO2 stream and maintain the CO2 stream above its bubble point pressure. The CO2 stream may then enter a vertical wellbore which comprises a second pressure such as a control valve, an orifice plate, or a choke which imparts a second pressure drop. The CO2 stream then enters a reservoir at a pressure below the minimum fracture pressure to avoid initiating and propagating fracture of the reservoir rock. The pressure at the point of injection into the reservoir rock may be measured in real-time and fed to a surface controller which actuates the control valve opening to maintain the desired pressure. The controller operation may be designed to include both the first and second pressure drop to simultaneously eliminate hydrogen evolution by phase separation at the surface and mitigate excessive pressure at the bottomhole.

Chemical additives may also be employed in the CO2 stream to lower the bubble point pressure to ensure that the CO2 stream is maintained above the bubble point pressure and below the minimum fracture pressure. Chemical additives may also alter the composition of the CO2 stream to the extent that the risk of phase separation and the evolution of hydrogen is mitigated.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
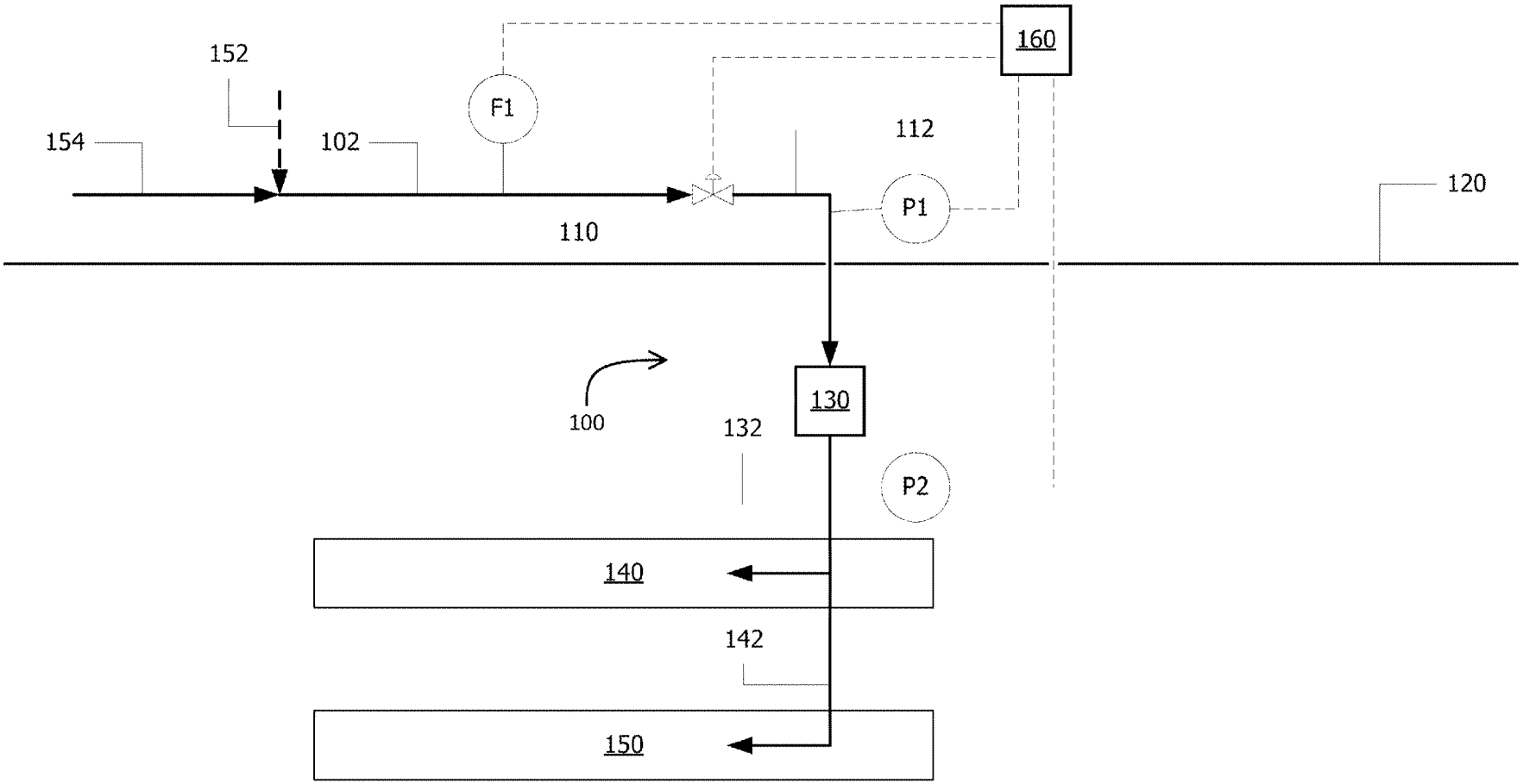
FIG. 1 is a schematic view depicting a method for injecting a carbon dioxide stream into a subsurface reservoir according to the present disclosure.

The present disclosure is directed to methods and systems for injection of a CO2 stream into a subsurface formation. Further, the present disclosure includes methods and systems using pressure reducers to meet the dual constraint of bubble point pressure and minimum fracture pressure, in order to keep a CO2 stream in a single phase and maintain integrity of the subsurface formation. The methods and systems disclosed herein may be utilized in processes such as subsea drilling and enhanced oil recovery. The CO2 stream may pass through a first pressure reducer such as a control valve at the surface which may impart a first pressure drop to the CO2 stream and maintain the CO2 stream above its bubble point pressure. The CO2 stream may then enter a vertical wellbore which comprises a second pressure such as a control valve, an orifice plate, or a choke which imparts a second pressure drop. The CO2 stream then enters a reservoir at a pressure below the minimum fracture pressure to avoid initiating and propagating fracture of the reservoir rock. The pressure at the point of injection into the reservoir rock may be measured in real-time and fed to a surface controller which actuates the control valve opening to maintain the desired pressure. The controller operation may be designed to include both the first and second pressure drop to simultaneously minimize or eliminate hydrogen evolution by phase separation at the surface and mitigate excessive bottomhole pressure.

In some embodiments, the CO2 stream may pass through a plurality of pressure reducers, wherein the plurality of pressure reducers may be at least two, at least three, or at least four pressure reducers, wherein at least two, at least three, or at least four pressure drops may be imparted on the CO2 stream. Alternatively, the CO2 stream may pass through two or more pressure reducers, wherein the two or more pressure reducers may impart to or more pressure drops on the CO2 stream. In some embodiments, the controller operation may be designed to include two or more pressure drops to minimize or eliminate hydrogen evolution by phase separation at the surface and mitigate excessive bottomhole pressure.

Chemical additives may also be employed in the CO2 stream to lower the bubble point pressure to ensure that the CO2 stream is maintained above the bubble point pressure and below the minimum fracture pressure. Chemical additives may also alter the composition of the CO2 stream to mitigate the risk of phase separation and the evolution of hydrogen.

Chemical additives suitable for use in the disclosed methods and systems include, but may not be limited to: methane, cyclohexane, and dimethyl ethers of polyethylene glycol. Chemical additives suitable for use in the disclosed methods and systems may be effective solvents for both CO2 and hydrogen. Chemical additives suitable for use in the disclosed methods and systems may react with hydrogen. The reaction of chemical additives with hydrogen may be exothermic.

FIG. 1 is a schematic view depicting a method for injecting a CO2 stream into a subsurface reservoir according to the present disclosure. CO2 injection stream 102 may be delivered by pipeline or other forms of transport such as tankers, railcars, ships, or any appropriate mode of transport. CO2 injection stream 102 may comprise impurities such as hydrogen, nitrogen, carbon monoxide, oxygen, hydrogen sulfide, and water. CO2 injection stream 102 may be reduced in pressure across first pressure reducer 110. In some embodiments, first pressure reducer 110 may be at ground level 120. In some embodiments, first pressure reducer 110 may be a dynamic pressure reducer, wherein a dynamic pressure reducer may be defined as a pressure reduction device with a flow coefficient that may be changed, such as a control valve. Reduced pressure CO2 stream 112 exits first pressure reducer 110, and at may be further reduced in pressure across second pressure reducer 130 at a lower depth than first pressure reducer 110. In some embodiments second pressure reducer 130 may be a static pressure reducer, defined as a pressure reduction device with a flow coefficient that is a only a function of the stream properties and the geometry of the pressure reduction device, such as an orifice plate or a choke. In some embodiments second pressure reducer 130 may be a dynamic pressure reducer. Further reduced pressure CO2 stream 132 may then be injected into reservoir 140. In some embodiments, second pressure reducer 130 may be located at a depth near the first pressure reducer 110 or the reservoir 140, or at the same depth as reservoir 140, and the depth may be selected based on the flow properties and composition of CO2 injection stream 102.

CO2 injection stream 102 may be maintained above the bubble point pressure to keep CO2 injection stream 102 in a single phase, and also further pressure reduced CO2 stream 132 may be maintained below the minimum fracture pressure for reservoir 140. Formation of a vapor phase at the wellhead may result in corrosion due to acid gas dropout and hydrogen embrittlement, which may require expensive corrosion-resistant alloys if two-phase flow occurs. Operating within both of these two constraints may be complicated by the static pressure head of the column of CO2 increasing the pressure at the bottom of injection well 100 due to gravity. The use of first pressure reducer 110 and second pressure reducer 130, which may be a static pressure reducer, counteract the pressure increase from a static head and allow both constraints to be met for a given flow rate of CO2 into reservoir 140.

Second pressure reducer 130 may also be used to reduce the temperature difference between the formation and the CO2 near a confining interval. The confining interval may be defined as a geologic layer that forms the top of reservoir 140 by preventing the vertical flow of CO2 and/or other fluids. When second pressure reducer 130 is located below the confining interval, the pressure drop from ground level 120 to reservoir 140 may be shifted from first pressure reducer 110 to second pressure reducer 130 for a given flowrate. The reduced pressure drop across first pressure reducer 110 may result in a lower temperature drop which may raise the temperature of reduced pressure CO2 stream 112 and may reduce differential thermal expansion between the well casing, the concrete, and the formation, particularly near the bottom of the confining interval.

In some embodiments, the flow coefficient of second pressure reducer 130 may be changed, for example, by removing and replacing second pressure reducer 130 in the case of a static pressure reducer, or by utilizing a dynamic pressure reducer as second pressure reducer 130. The flow coefficient of second pressure reducer 130 may require changing due to changes in reservoir 140 behavior, seasonal changes in ground temperature, turndown conditions requiring low injection flow rates, the gradual increase in the pressure of reservoir 140 over time as more CO2 is injected, and changes in the composition of CO2 injection stream 102.

Changing the flow coefficient of second pressure reducer 130 is also beneficial when considering a plurality of injection wells sharing a pipeline or a network of connected pipelines. The pipeline may be operated at a high enough pressure to inject CO2 into the injection well 100 that requires the highest pressure due to factors including, but not limited to, greater depth of reservoir 140, higher CO2 temperature (i.e. closest to a CO2 compressor), lower injectivity, and higher CO2 flow rate. Injectivity may be defined as the difference between reservoir 140 pressure and the pressure in the bottom of injection well 100 as a function of CO2 flow rate in units of flow rate per unit pressure. In some embodiments, injection well 100 may require a lower pressure to inject and may require a large pressure drop across second pressure reducer 130 which corresponds to a larger temperature drop via Joule-Thompson cooling. A lower CO2 temperature, in turn, may increase the density of the CO2, further reducing the wellhead pressure.

The temperature of CO2 injection stream 102 may also be controlled by increasing or decreasing the temperature leaving a compressor (not shown) delivering CO2 injection stream 102 to the pipeline (not shown). As a surprising result, the thermal mass of CO2 injection stream 102 may be high enough to maintain an elevated temperature over tens of kilometers of pipeline without having the CO2 injection stream 102 reach ambient temperature. The elevated temperature may then reduce the differential expansion between the well casing, the concrete, and the formation (not shown).

Injection well 100 may comprise a central conduit, through which the reduced pressure CO2 stream 112 is injected, surrounded by an annular space isolated at the top and bottom of the annular space (not shown). A heat transfer fluid such as water may be circulated through the annular space to transfer geothermal heat along the length of the annular space to the well to reduce thermal stress. The heat transfer fluid may also be monitored to allow pressure testing and/or radioactive tracer testing. The heat transfer fluid may be circulated through a loop of tubing (not shown) inserted into the annular space. The loop of tubing may be attached and/or clamped to the well.

In some embodiments, first pressure reducer 110 may be controlled by a controller 160 that may change the flow coefficient of first pressure reducer 110 in response to one or more sensors, including a flow sensor F1 on CO2 injection stream 102, a first pressure sensor P1 on reduced pressure CO2 stream 112, and a second pressure sensor P2 located at or near reservoir 140. In this way the flow coefficient of first pressure reducer 110 may be changed to keep the pressure of further reduced pressure CO2 stream 132 below the minimum fracture pressure of reservoir 140. The temperature of reduced pressure CO2 stream 112 and/or the temperature of further reduced pressure CO2 stream 132 may also be measured as the bubble point is also a function of temperature. In addition, a decrease in temperature of the carbon dioxide in injection well 100 can generate a positive feedback loop in which the density of the carbon dioxide increases, causing the hydrostatic head pressure drop between reservoir 140 and ground level 120 to increase, which in turn increases the Joule-Thompson cooling across first pressure reducer 110 and/or second pressure reducer 130, further reducing the temperature of reduced pressure CO2 stream 112 and/or the temperature of further reduced pressure CO2 stream 132.

In some embodiments, controlling the pressure of further reduced pressure CO2 stream 132 using first pressure reducer 110 may allow injection into deeper reservoir 150. Deeper reservoir 150 may be another section of the same reservoir as reservoir 140 or another geologic layer. Deeper reservoir 150 is underneath a greater weight of rock and so may have a higher minimum fracture pressure than reservoir 140. In at least some embodiments, without changing the flow coefficient of first pressure reducer 110, further reduced pressure CO2 stream 132 may be above the minimum fracture pressure at the depth of reservoir 140 but below the minimum fracture pressure at the depth of deeper reservoir 150. Changing the flow coefficient of first pressure reducer 110 allows injection of CO2 into a wider range of depths while maintaining safe operation below the minimum fracture pressure. The control scheme may be designed such that second pressure reducer 130 may ensure that further reduced pressure CO2 stream 132 is above the bubble point pressure over the full range of depths to inject, and the flow coefficient of first pressure reducer 110 is changed to control the pressure of further reduced pressure CO2 stream 132 at a level below the minimum fracture pressure of the current target injection depth.

In some embodiments, multiple injection wells 100 in fluid flow communication with the same CO2 source may also be controlled using a first pressure reducer 110 and a second pressure reducer 130 at a lower depth than first pressure reducer 110 for each injection well 100. The second pressure reducer 130 for each injection well 100 may be at the same or different depths. This may allow each injection well 100 to be controlled independently and maintain the CO2 pressure at the depth of each reservoir 140,150 to be below the corresponding minimum fracture pressure. In cases in which the wellhead with the highest pressure is close in pressure to the pipeline pressure, second pressure reducer 130 for the wellhead with the highest pressure may be eliminated.

There may be conditions due to geology, flow conditions, or carbon dioxide composition under which the dual constraint of the bubble point pressure and the minimum fracture pressure cannot both be met. In this case, one or more chemical additives 152 may be used to lower the bubble point pressure of raw CO2 stream 154 to produce CO2 injection stream 102 that may be more suitable for injection into reservoir 140. In some embodiments, one or more chemical additives 152 may be added to raw CO2 stream 154. In at least some embodiments, raw CO2 stream 154 may have a high bubble point pressure due to the presence of more than 0.1 mol %, more than 0.5 mol % hydrogen, or more than 2 mol % hydrogen. It may be preferable to capture CO2 that may have a significant concentration of hydrogen as described above as there are additional capital and operating costs associated with removing hydrogen from CO2 at the point of capture. For example, when CO2 is captured with an absorption system such as amine absorbers, reducing the concentration of hydrogen in the captured CO2 requires a high pressure flash and/or operating the reboiler with a higher heating duty. In some embodiments, the maximum concentration of hydrogen will be the solubility limit of hydrogen in CO2 at the temperature and pressure of raw CO2 stream 154. One or more chemical additives 152 may operate by a physical method in which the critical point of the CO2 stream is increased, and/or the solubility of carbon dioxide for gas phases that the impurities may form is increased, in which case the desired properties of one or more chemical additives 152 may include high solubility for both CO2 and hydrogen. One or more chemical additives 152 may operate by a chemical or electrochemical method in which the impurities are consumed by chemical reaction with one or more chemical additives 152 and/or bulk CO2.

In some embodiments one or more chemical additives 152 may be used during a cold start condition or re-start after turndown during which the pressure of CO2 injection stream 102 may be below normal steady-state operating pressure.

Figure 2:
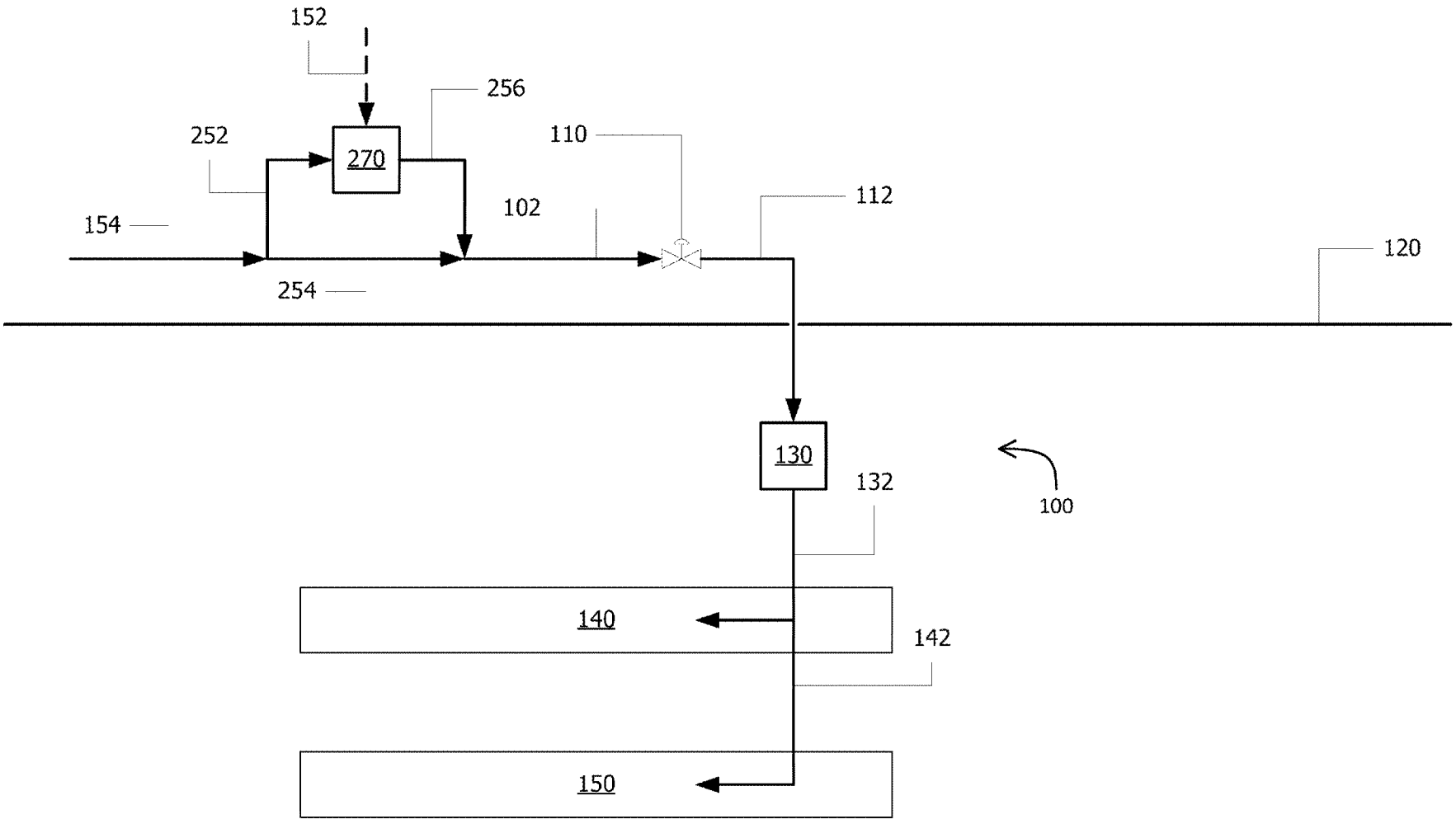
FIG. 2 is a schematic view depicting a modification of FIG. 1 in which a bypass stream is combined with one or more chemical additives.

FIG. 2 is a schematic view depicting a modification of FIG. 1 in which a bypass stream is combined with one or more chemical additives. Raw carbon dioxide stream 154 is divided into raw bypass stream 252 and second raw carbon dioxide stream 254. Raw bypass stream 252 may feed in-line reactor 270 in which one or more chemical additives 152 may be combined with raw bypass stream 252. In-line reactor 270 may comprise a catalyst in the form or a fixed bed or monolith. In-line reactor 270 may comprise an electrochemical converter that may oxidize at least a portion of the hydrogen present in raw bypass stream 252 at an anode and reduce a reactant such as carbon dioxide or atmospheric oxygen at the cathode. In the case of carbon dioxide reduction, the electricity required to drive the reaction may be supplied by renewable sources. In the case of oxygen reduction, electricity would not be required, as the electrochemical converter would function as a hydrogen fuel cell that may generate useful electrical power. In some embodiments, hydrogen in raw bypass stream 252 may be reacted with carbon dioxide and/or atmospheric oxygen without the addition of one or more chemical additives 152. Treated bypass stream 256 may then be recombined with second raw carbon dioxide stream 254 to form carbon dioxide injection stream 102. In at least some embodiments this configuration allows the operator to control the amount of chemical and/or electrochemical reaction by changing the fraction of raw carbon dioxide stream 154 that is divided to form raw bypass stream 252.

In at least some embodiments, the treated bypass stream 256 may be reduced in pressure across a second first pressure reducer and recombined with the reduced pressure carbon dioxide stream 112 downstream of the first pressure reducer 110 (not shown). In this case the first pressure reducer 110 may be closed completely and the second first pressure reducer used to control the pressure of the reduced pressure CO2 stream 112 and further reduced pressure CO2 stream 132.

In some embodiments the in-line reactor 270 may be used during a cold start condition or re-start after turndown during which the pressure of CO2 injection stream 102 is below normal steady-state operating pressure.

In some embodiments one or more chemical additives 152 and/or in-line reactor 270 may be used without second pressure reducer 130.

Figure 3:
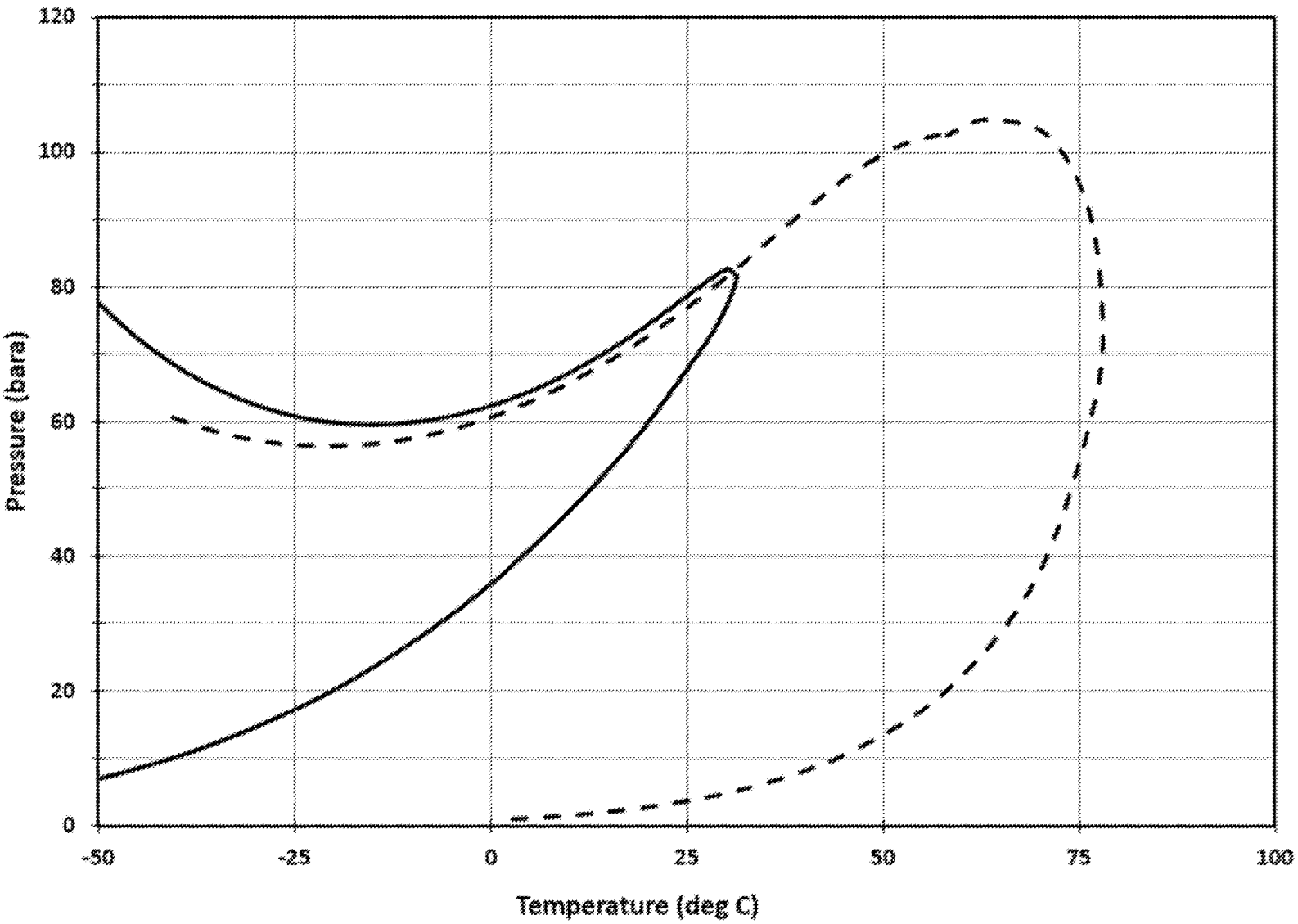
FIG. 3 is a plot of two-phase envelopes of two carbon dioxide streams with different compositions.

FIG. 3 is a plot of two-phase envelopes of two carbon dioxide streams with different compositions. The two-phase envelope is graphed on a pressure-temperature plot: the solid line for a 98 mol % CO2 and 2 mol % H2 mixture and the dashed line for a mixture of 95 parts of a 98 mol % CO2 and 2 mol % H2 mixture with 5 parts methanol. The bubble point curve, the trace of P-T points where bubbles of vapor first form in the liquid phase, is the top portion of the curve and the dew point curve, the trace of P-T points where droplets of liquid first form in the vapor phase, is the bottom portion of the curve. Liquid and vapor phases coexist between the top and bottom portions of the curve. In at least some embodiments, the pressure and temperature of the carbon dioxide stream will both increase as the depth increases, so keeping the carbon dioxide stream at the depth of the first pressure reducer 110 above the bubble point curve will maintain single phase flow down the injection well 100. It can be seen that the addition of methanol lowers the bubble point curve for ambient temperatures below about 30° C., which in turn allows a lower pressure of the further reduced pressure carbon dioxide stream 132 as it is injected into the reservoir 140.

A person of skill in the art will appreciate that the lowering of the bubble point curve in FIG. 3 is by a relatively small amount. Physical solvents are more effective at lowering the bubble point curve for carbon dioxide streams with negligible amounts of light components like hydrogen. A physical solvent like methanol that has good solubility with CO2 tends to have poor solubility with H2, reducing its overall effectiveness. In at least some embodiments, it may be more effective if the one or more chemical additives operate by a chemical method. In cases with more than 0.5% H2, the one or more chemical additives may comprise a copper-based catalyst that reacts hydrogen with carbon dioxide to form methanol, a compound that is much more soluble in carbon dioxide. Industrially, most copper-based catalysts have low conversion for the methanol-forming reaction, for example 20-40%. However, in the present disclosure, a low conversion of hydrogen to form methanol may be sufficient to lower the bubble point pressure enough to allow meeting the dual constraint of the bubble point pressure and the minimum fracture pressure. In at least some embodiments, the one or more chemical additives may catalyze the reaction of hydrogen with carbon dioxide to form formate or formic acid. The one or more chemical additives may operate via both physical and chemical/electrochemical methods, whether a single chemical additive fulfills both methods or two separate chemical additives, one operating via a physical method and one operating via a chemical/electrochemical method. The chemical/electrochemical method may include a hydrogen-consuming reaction such as

H2+CO2=>HCOOH or

3H2+CO2=>CH3OH+H2O in which the reaction occurs in a packed catalyst bed or at a cathode of an electrochemical cell. The electrochemical method may include oxidizing hydrogen to form 2H+ ions at the anode, which can then combine with a reactant such as oxygen or carbon dioxide at the cathode. In the case of the electrochemical method combining with carbon dioxide, the relative amount of formic acid and methanol formed may be a function of the overpotential voltage.

In at least some embodiments the chemical reaction consuming hydrogen may be exothermic. The heat of reaction generated by the consumption of hydrogen may have the additional benefit of increasing the temperature of CO2 injection stream 102 to reduce the risk of freezing when the ambient temperature is low and/or reduce the differential thermal expansion between the well casing, the concrete, and the formation.

Aspect 1: A method comprising delivering an carbon dioxide injection stream to a first wellhead; reducing the pressure of the carbon dioxide injection stream with a first pressure reducer having a depth and producing a reduced pressure carbon dioxide stream; reducing the pressure of the reduced pressure carbon dioxide stream with a second pressure reducer, wherein the second pressure reducer is positioned at a lower depth than the first pressure reducer, and producing a further reduced pressure carbon dioxide stream; and injecting the further reduced pressure carbon dioxide stream into a reservoir having a depth; and wherein the pressure of the carbon dioxide injection stream at the depth of the first pressure reducer is greater than a bubble point pressure of the carbon dioxide stream at the depth of the first pressure reducer; wherein the pressure of the further reduced pressure carbon dioxide stream at the depth of the reservoir is less than a minimum fracture pressure of the reservoir at the depth of the reservoir.

Aspect 2: A method according to Aspect 1, wherein the carbon dioxide injection stream comprises at least 0.1 mol % hydrogen.

Aspect 3: A method according to Aspect 1 or Aspect 2, wherein a confining interval is located above the depth of the reservoir and the second pressure reducer is located at a lower depth than the confining interval.

Aspect 4: A method according to any of Aspects 1 to 3, further comprising combining at least one chemical additive with a raw carbon dioxide stream having a bubble point pressure to produce the carbon dioxide injection stream; wherein the bubble point pressure of the carbon dioxide injection stream is lower than the bubble point pressure of the raw carbon dioxide stream.

Aspect 5: A method according to Aspect 4, wherein the raw carbon dioxide stream comprises hydrogen; and wherein the at least one chemical additive causes a chemical reaction consuming at least a portion of the hydrogen in the raw carbon dioxide stream.

Aspect 6: A method according to Aspect 5, wherein the chemical reaction consuming at least a portion of the hydrogen in the raw carbon dioxide stream is exothermic.

Aspect 7: A method according to any of Aspects 1 to 6, further comprising reacting carbon dioxide with hydrogen in a raw carbon dioxide stream having a bubble point pressure in the presence of a catalyst to produce a treated carbon dioxide stream; wherein the bubble point pressure of the treated carbon dioxide stream is lower than the bubble point pressure of the raw carbon dioxide stream; and wherein the carbon dioxide injection stream comprises the treated carbon dioxide stream.

Aspect 8: A method according to any of Aspects 1 to 7, further comprising measuring the pressure of the further reduced pressure carbon dioxide stream at the depth of the reservoir; and controlling the pressure of the further reduced pressure carbon dioxide stream at the depth of the reservoir by changing a flow coefficient of the first pressure reducer and/or a flow coefficient of the second pressure reducer.

Aspect 9: A method according to any of Aspects 1 to 8, injecting the further reduced pressure carbon dioxide stream into a deeper reservoir having a depth; wherein the pressure of the further reduced pressure carbon dioxide stream at the depth of the deeper reservoir is less than the minimum fracture pressure of the deeper reservoir at the depth of the deeper reservoir.

Aspect 10: A method according to any of Aspects 1 to 9, further comprising controlling a temperature of the further reduced pressure carbon dioxide stream by changing the flow coefficient of the first pressure reducer and/or the second pressure reducer.

Aspect 11: A method according to any of Aspects 1 to 10, further comprising delivering a portion of the carbon dioxide injection stream to a second wellhead; reducing the pressure of the portion of the carbon dioxide injection stream with a third pressure reducer having a depth and producing a second reduced pressure carbon dioxide stream; reducing the pressure of the second reduced carbon dioxide stream with a fourth pressure reducer, wherein the fourth pressure reducer is positioned at a lower depth than the third pressure reducer, and producing a second further reduced pressure carbon dioxide stream; and injecting the second further reduced carbon dioxide stream into a second reservoir having a depth; wherein the pressure of the portion of the carbon dioxide injection stream at the depth of the third pressure reducer is greater than a bubble point pressure of the portion of the carbon dioxide stream at the depth of the third pressure reducer; wherein the pressure of the second further reduced pressure carbon dioxide stream at the depth of the second reservoir is less than a minimum fracture pressure of the second reservoir at the depth of the second reservoir.

Aspect 12: A method comprising delivering an carbon dioxide injection stream to a first wellhead; reducing the pressure of the carbon dioxide injection stream with a first pressure reducer having a depth and producing a reduced pressure carbon dioxide stream; reducing the pressure of the reduced pressure carbon dioxide stream with at least a second pressure reducer, wherein the at least second pressure reducer is positioned at a lower depth than the first pressure reducer, and producing a further reduced pressure carbon dioxide stream; and injecting the further reduced pressure carbon dioxide stream into at least one reservoir having a depth; wherein the pressure of the carbon dioxide injection stream at the depth of the first pressure reducer is greater than a bubble point pressure of the carbon dioxide stream at the depth of the first pressure reducer; wherein the pressure of the further reduced pressure carbon dioxide stream at the depth of the at least one reservoir is less than a minimum fracture pressure of the at least one reservoir at the depth of the at least one reservoir.

Aspect 13: A system comprising a first pressure reducer in fluid flow communication with an carbon dioxide injection stream; a second pressure reducer in fluid flow communication with the first pressure reducer, wherein the second pressure reducer is positioned at a lower depth than the first pressure reducer; a reservoir in fluid flow communication with the second pressure reducer; a controller configured to receive an electrical signal from at least one of a first pressure sensor downstream of the first pressure reducer, a second pressure sensor downstream of the second pressure reducer, and a flow sensor on the carbon dioxide stream; and output an electrical signal to control a flow coefficient of the first pressure reducer.

Aspect 14: A system according to Aspect 13, further comprising an injector in fluid flow communication with the first pressure reducer configured to combine at least one chemical additive with a raw carbon dioxide stream.

Aspect 15: A system according to Aspect 13 or Aspect 14, further comprising a reactor in fluid flow communication with the first pressure reducer configured to accept at least a portion of a raw carbon dioxide stream and produce a treated carbon dioxide stream.

Aspect 16: A system according to any of Aspects 13 to 14, further comprising a reactor in fluid flow communication with the first pressure reducer configured to accept at least a portion of a raw carbon dioxide stream and produce a treated carbon dioxide stream; wherein the reactor comprises an electrochemical converter comprising an anode configured to oxidize hydrogen and a cathode configured to reduce at least one of carbon dioxide and oxygen.

Aspect 17: A system according to any of Aspects 13 to 16, further comprising a deeper reservoir at a fourth level in fluid flow communication with the second pressure reducer.

Aspect 18: The system according to Aspect 13, further comprising at least a third pressure reducer in fluid flow communication with the first pressure reducer, wherein the at least third pressure reducer is positioned at a lower depth than the first pressure reducer.

Aspect 19: The system according to Aspect 13, wherein the controller is further configured to receive an electrical signal from at least a third pressure sensor downstream of an at least third pressure reducer.

Aspect 20: The system according to Aspect 13, further comprising at least a second reservoir in fluid flow communication with either the second pressure reducer or at least a third pressure reducer.

To facilitate a better understanding of the present disclosure, the following examples of certain aspects of some of the methods and systems are given. In no way should the following example be read to limit, or define, the entire scope of the disclosure.

EXAMPLES

Figure 4:
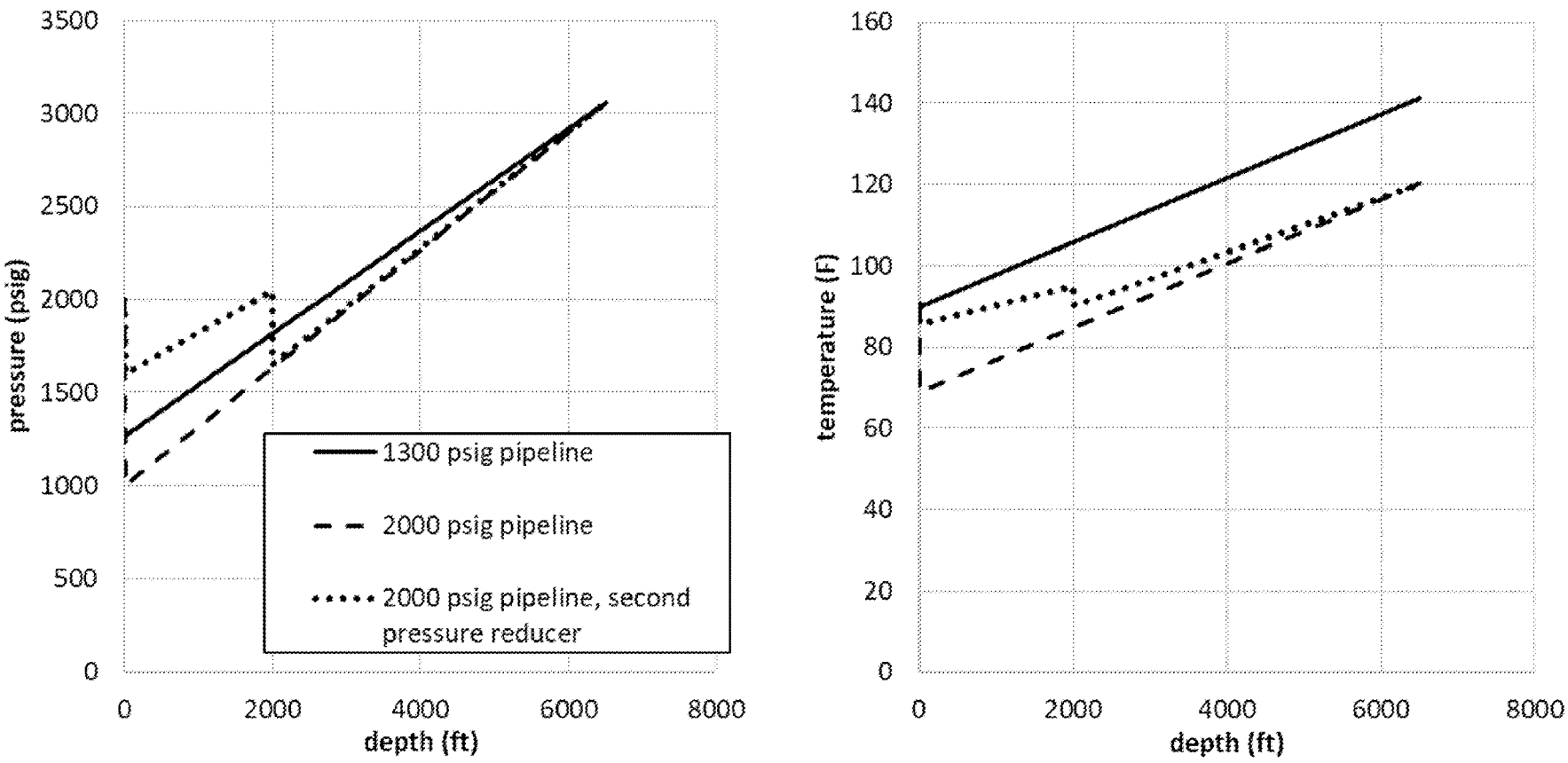
FIG. 4 is a plot of pressure and temperature profiles as a function of depth for an injection well under three conditions.

Three CO2 injection wells were modeled using proprietary thermodynamic data for a CO2 stream with 2% H2. FIG. 4 is a plot of pressure and temperature profiles as a function of depth for an injection well under three conditions. The first case models a single well with a first pressure reducer near ground level was modeled using a wellhead pressure of 1265 psig and 90° F. FIG. 4 is a plot of pressure and temperature profiles as a function of depth for an injection well under three conditions. The corresponding bubble point is 1088 psig, safely below the wellhead pressure therefore in a single phase. The pipeline pressure is 1300 psig, so any Joule-Thompson cooling across the first pressure reducer is negligible. The second case considers adding a second well requiring a higher pressure to the same pipeline, resulting in the pipeline pressure increasing to 2000 psig. The first well has a much higher pressure drop across the first pressure reducer, decreasing the temperature at the wellhead from 90° F. to 69° F. and the pressure at the wellhead from 1265 psig to 1000 psig. The pressure at the first well is now below the bubble point, causing two-phase flow and potential hydrogen embrittlement from the hydrogen-rich vapor phase. In the third case adds a second pressure reducer to the first well at a depth of 2000 ft, which shifts most of the pressure drop from 2000 psig to 1265 psig from the first pressure reducer to the second pressure reducer and keep the wellhead above the bubble point.

It should be understood that, although individual examples may be discussed herein, the present disclosure covers all combinations of the disclosed examples, including, without limitation, the different component combinations, method step combinations, and properties of the system.

It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces.

All numerical values within the detailed description and the claims herein modified by "about" or "approximately" with respect to the indicated value are intended to consider experimental error and variations that would be expected by a person having ordinary skill in the art.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

The invention claimed is:

1. A method comprising:

delivering a carbon dioxide injection stream to a first wellhead;

reducing the pressure of the carbon dioxide injection stream with a first pressure reducer having a first depth and producing a reduced pressure carbon dioxide stream;

reducing the pressure of the reduced pressure carbon dioxide stream with a second pressure reducer, wherein the second pressure reducer is positioned at a lower depth than the first pressure reducer, and producing a further reduced pressure carbon dioxide stream;

injecting the further reduced pressure carbon dioxide stream into a reservoir having a reservoir depth; and combining at least one chemical additive with a raw carbon dioxide stream having a bubble point pressure to produce the carbon dioxide injection stream;

wherein the pressure of the carbon dioxide injection stream at the first depth is greater than a bubble point pressure of the carbon dioxide stream at the first depth; and wherein the pressure of the further reduced pressure carbon dioxide stream at the reservoir depth is less than a minimum fracture pressure of the reservoir at the reservoir depth;

wherein the bubble point pressure of the carbon dioxide injection stream is lower than the bubble point pressure of the raw carbon dioxide stream; and wherein the chemical additive is selected from the group consisting of methane;

cyclohexane; dimethyl ethers of polyethylene glycol; a catalyst that reacts hydrogen with carbon dioxide to form methanol, formate, or formic acid; or an electrochemical cell.

2. The method of claim 1, wherein the carbon dioxide injection stream comprises at least 0.1 mol % hydrogen.

3. The method of claim 1, wherein a confining interval is located above the reservoir depth and the second pressure reducer is located at a lower depth than the confining interval.

4. The method of claim 1 wherein the raw carbon dioxide stream comprises hydrogen; and wherein the at least one chemical additive causes a chemical reaction consuming at least a portion of the hydrogen in the raw carbon dioxide stream.

5. The method of claim 4, wherein the chemical reaction consuming at least a portion of the hydrogen in the raw carbon dioxide stream is exothermic.

6. The method of claim 1, further comprising measuring the pressure of the further reduced pressure carbon dioxide stream at the reservoir depth; and controlling the pressure of the further reduced pressure carbon dioxide stream at the reservoir depth by changing a flow coefficient of the first pressure reducer and/or a flow coefficient of the second pressure reducer.

7. The method of claim 1, further comprising:

injecting the further reduced pressure carbon dioxide stream into a deeper reservoir having a deeper reservoir depth;

wherein the pressure of the further reduced pressure carbon dioxide stream at the deeper reservoir depth is less than the minimum fracture pressure of the deeper reservoir at the deeper reservoir depth.

8. The method of claim 1, further comprising controlling a temperature of the further reduced pressure carbon dioxide stream by changing the flow coefficient of the first pressure reducer and/or the second pressure reducer.

9. The method of claim 1, further comprising:

delivering a portion of the carbon dioxide injection stream to a second wellhead;

reducing the pressure of the portion of the carbon dioxide injection stream with a third pressure reducer having a third depth and producing a second reduced pressure carbon dioxide stream;

reducing the pressure of the second reduced carbon dioxide stream with a fourth pressure reducer, wherein the fourth pressure reducer is positioned at a lower depth than the third pressure reducer, and producing a second further reduced pressure carbon dioxide stream; and injecting the second further reduced carbon dioxide stream into a second reservoir having a second reservoir depth;

wherein the pressure of the portion of the carbon dioxide injection stream at the third depth is greater than a bubble point pressure of the portion of the carbon dioxide stream at the third depth;

wherein the pressure of the second further reduced pressure carbon dioxide stream at the second reservoir depth is less than a minimum fracture pressure of the second reservoir at the second reservoir depth.

10. A system comprising:

a first pressure reducer in fluid flow communication with a carbon dioxide injection stream;

a second pressure reducer in fluid flow communication with the first pressure reducer, wherein the second pressure reducer is positioned at a lower depth than the first pressure reducer;

a reservoir in fluid flow communication with the second pressure reducer;

a controller configured to receive an electrical signal from at least one of a first pressure sensor downstream of the first pressure reducer, a second pressure sensor downstream of the second pressure reducer, and a flow sensor on the carbon dioxide stream; and output an electrical signal to control a flow coefficient of the first pressure reducer; and an injector or a reactor in fluid flow communication with the first pressure reducer configured to combine at least one chemical additive with a raw carbon dioxide stream having a bubble point pressure to produce the carbon dioxide injection stream;

wherein the pressure of the carbon dioxide stream at the first pressure reducer is greater than a bubble point pressure of the carbon dioxide stream at the first pressure reducer;

wherein the pressure of the carbon dioxide stream at the depth of the reservoir is less than a minimum fraction pressure of the reservoir at the depth of the reservoir;

wherein the bubble point pressure of the carbon dioxide infection stream is lower than the bubble point pressure of the raw carbon dioxide stream; and wherein the chemical additive is selected from the group consisting of methane; cyclohexane; dimethyl ethers of polyethylene glycol; a catalyst that reacts hydrogen with carbon dioxide to form methanol, formate, or formic acid; or an electrochemical cell.

11. The system of claim 10, further comprising a deeper reservoir in fluid flow communication with the second pressure reducer.

12. The system of claim 10, further comprising at least a third pressure reducer in fluid flow communication with the first pressure reducer, wherein the at least third pressure reducer is positioned at a lower depth than the first pressure reducer.

13. The system of claim 10, wherein the controller is further configured to receive an electrical signal from at least a third pressure sensor downstream of an at least third pressure reducer.

14. The system of claim 10, further comprising at least a second reservoir in fluid flow communication with either the second pressure reducer or at least a third pressure reducer.

15. A method comprising:

reacting carbon dioxide with hydrogen in a raw carbon dioxide stream having a bubble point pressure in the presence of a catalyst to produce a treated carbon dioxide stream;

delivering a carbon dioxide injection stream to a first wellhead;

reducing the pressure of the carbon dioxide injection stream with a first pressure reducer having a first depth and producing a reduced pressure carbon dioxide stream;

reducing the pressure of the reduced pressure carbon dioxide stream with a second pressure reducer, wherein the second pressure reducer is positioned at a lower depth than the first pressure reducer, and producing a further reduced pressure carbon dioxide stream; and injecting the further reduced pressure carbon dioxide stream into a reservoir having a reservoir depth;

wherein the pressure of the carbon dioxide injection stream at the first depth is greater than a bubble point pressure of the carbon dioxide stream at the first depth;

wherein the pressure of the further reduced pressure carbon dioxide stream at the reservoir depth is less than a minimum fracture pressure of the reservoir at the reservoir depth;

wherein the bubble point pressure of the treated carbon dioxide stream is lower than the bubble point pressure of the raw carbon dioxide stream; and wherein the carbon dioxide injection stream comprises the treated carbon dioxide stream.

* * * * *